US010219350B2

(12) United States Patent
Miles

(10) Patent No.: US 10,219,350 B2
(45) Date of Patent: Feb. 26, 2019

(54) ELECTROLUMINESCENT ELEMENTS AND METHODS OF CONSTRUCTION

(71) Applicant: DST Innovations Limited, Bridgend (GB)

(72) Inventor: Anthony Miles, Bridgend (GB)

(73) Assignee: DST Innovations Limited, Bridgend (GB)

( * ) Notice: Subject to any disclaimer, the term of this patent is extended or adjusted under 35 U.S.C. 154(b) by 0 days.

(21) Appl. No.: 15/534,804

(22) PCT Filed: Dec. 8, 2015

(86) PCT No.: PCT/GB2015/053757

§ 371 (c)(1),
(2) Date: Jun. 9, 2017

(87) PCT Pub. No.: WO2016/092292

PCT Pub. Date: Jun. 16, 2016

(65) Prior Publication Data

US 2018/0270929 A1 Sep. 20, 2018

(30) Foreign Application Priority Data

Dec. 9, 2014 (GB) ..... 1421887.9

(51) Int. Cl.
*H01J 1/62* (2006.01)
*H05B 33/22* (2006.01)
*H05B 33/26* (2006.01)

(52) U.S. Cl.
CPC ..... *H05B 33/22* (2013.01); *H05B 33/26* (2013.01)

(58) Field of Classification Search
USPC ..... 313/506, 498
See application file for complete search history.

(56) References Cited

U.S. PATENT DOCUMENTS

| | | | |
|---|---|---|---|
| 3,201,633 | A | 8/1965 | Lieb |
| 5,976,613 | A | 11/1999 | Janusauskas |
| 2013/0134400 | A1 | 5/2013 | Tsutsui |

FOREIGN PATENT DOCUMENTS

| | | |
|---|---|---|
| JP | S63276898 | 11/1988 |
| JP | 3258780 | 2/2002 |

OTHER PUBLICATIONS

International Search Report for Corresponding WO Application No. PCT/GB2015/053757 dated Dec. 8, 2015.
Combined Search and Examination Report issued in GB1421887.9 dated Mar. 25, 2015.

*Primary Examiner* — Vip Patel
(74) *Attorney, Agent, or Firm* — Morris & Kamlay LLP

(57) ABSTRACT

An electroluminescent element comprises at least the following layers, in sequence: a first substrate (1), a first conductive layer (2), a first dielectric layer (3), a first light emitting layer (4), a second conductive layer (5), a second light emitting layer (4'), a second dielectric layer (3'), a third conductive layer (2'), and a second substrate (6). At least one of the first and second substrates (1, 6) is transparent or translucent; and at least some of the layers are transparent or translucent so as to allow light from the first and/or second light emitting layers (4, 4') to be emitted through the transparent substrate or substrates (1, 6). The second conductive layer (5) may be encapsulated between the first and second light emitting layers (4) and between the first and second dielectric layers (3, 3'). The elements may be stacked horizontally or vertically.

19 Claims, 3 Drawing Sheets

ELECTROLUMINESCENT ELEMENTS AND METHODS OF CONSTRUCTION

FIELD OF THE INVENTION

This invention relates to electroluminescent elements and methods of constructing them.

BACKGROUND OF THE INVENTION

Electroluminescent (EL), Organic Light Emitting Diode (OLED), and light emitting polymers are known. One early example of an EL capacitor is disclosed in U.S. Pat. No. 3,201,633.

SUMMARY OF THE INVENTION

Aspects of the invention are defined in the accompanying claims.

Embodiments of the invention may provide electroluminescent (EL) elements having an improved light output.

Embodiments of the invention may provide EL elements with significantly reduced crosstalk between adjacent elements.

Embodiments of the invention include the configuration of the conductive material, such that the conductive materials formed on their respective substrates can be connected together to form a conductor that can be energised simultaneously, independent of an encapsulated conductive material at the centre of the element.

Embodiments of the invention include methods of construction of EL elements using a coating with a hole transport substance and an electron transport layer. The hole transport substance is designed to improve and promote the transport efficiency of positive charge within the element. The electron transport layer may improve the flow of negatively charged particles.

A further embodiment of the invention includes the use of a semiconductor substance layered on one side of a substrate that provides a switch threshold control to a conducting layer, providing more control over the light emitting element's light production.

Other embodiments of the invention may use any combination of the specific configurations to produce an array of EL elements that are stacked in the vertical axis of the element. Such construction enables each element within the stack to be energised individually and/or in a collective group. This construction method prevents or reduces crosstalk between the layers enabling the stacked construction to work more effectively.

Embodiments of the invention may use any combination of the specific configurations to produce an array of EL elements that are aligned in the horizontal axis of the elements. Such a construction enables the array of EL elements to be placed in a configuration that can be flexed with little impact to the EL elements structures and their related electrical contacts. Such a system is beneficial when creating flexible lighting or displays.

BRIEF DESCRIPTION OF THE DRAWINGS

There now follows, by way of example only, a detailed description of embodiments of the present invention, with reference to the figures identified below.

DETAILED DESCRIPTION OF EMBODIMENTS OF THE INVENTION

Electroluminescent Elements

Figure 1:
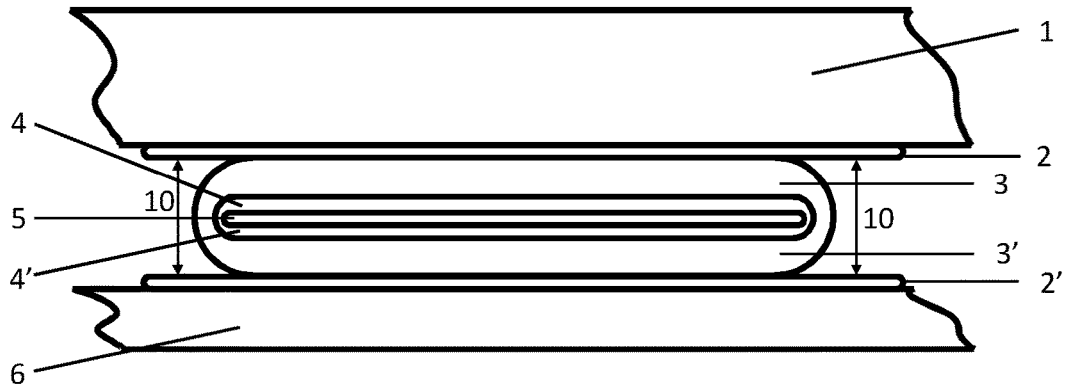
FIG. 1 is a schematic cross-sectional diagram of an electroluminescent element in an embodiment.

FIG. 1 is a cross sectional diagram illustrating the different layers of an electroluminescent element in an embodiment of the invention. The element comprises the following layers: a first substrate 1, a first and third conductive substance 2 and 2', a first and second dielectric substance 3 and 3', a first and second light emitting substance 4 and 4', a second conductive substance 5, a second transparent substrate 6 and cavity region 10.

A process and materials for construction of the EL elements will now be described.

A first transparent substrate 1, which can be glass, paper, wood, plastic, fabric, metal or any composite material is printed or coated with a first transparent or coloured conductive material 2, using for example a screen printing process that is known in the art. The printing or coating process is to include, but is not limited to, processes known in the art such as flexographic printing, lithographic printing, ink jet printing, rotogravure printing, spray coating or stencil printing.

The first transparent or coloured conductive material 2 may be formed into a pattern that conforms to a circuit design that constitutes a matrix or other connection type structure, in and around the electroluminescent device. A transparent or coloured dielectric 3 is then printed or coated on the first transparent or coloured conductive material 2, forming a shape that will be larger than the next layer to be printed or coated, and larger than the transparent or coloured conductive material. This larger dielectric shape will form part of the encapsulation for other conductive layers utilising screen printing or any other method of coating or printing known in the art. A light emitting substance 4 is then printed or coated in a smaller shape than the former layer of dielectric 3 and will form part of the encapsulation for other conductive layers.

The second transparent or coloured conductive material 5 is then printed or coated on the surface of the light emitting substance 4. This second transparent or coloured conductive material 5 must be smaller than the light emitting substance 4, to enable the encapsulation of the conductor by the light emitting substance 4.

The light emitting substance 4 is then printed or coated, in a larger size, over the surface of the second transparent or coloured conductive material 5, encapsulating it in the light emitting substance 4. A portion of the second transparent or coloured conductive material 5 may be connected to an electronic circuit, meaning that a portion of the encapsulated second transparent or coloured conductive material 5 will be exposed in some way to enable connection to other sections of an electronic circuit. In the event that the configuration is a passive or active matrix, the second transparent or coloured conductive material 5 will be arranged in a row column configuration.

The light emitting substance 4 is then printed or coated with a transparent or coloured dielectric 3, encapsulating the light emitting substance 4, and the second transparent or coloured conductive material 5, that has already been encapsulated by the light emitting substance 4.

The first conductive material 2 may be formed into a pattern that conforms to a circuit design, dependent on the configuration of the electroluminescent device.

The cavities 10 that are left by the encapsulation process may be filled by an insulator that provides additional isolation between light emitting elements and smooths out the surface for further printing or coating of material. The assembly process as described in FIG. 1 can also be done in reverse order.

The light emitting system is then printed or coated with a second substrate 6, which can be glass, paper, wood, plastic, fabric, metal or any composite material. This second substrate 6 may already have been printed or coated with the third transparent or coloured conductive material 2'. The process order may be reversed so that transparent substrate could be printed or coated onto the pre-assembled encapsulated elements, as described in FIG. 1.

The configuration of this embodiment allows both the first and third conductive materials 2, 2' to be connected together to form a conductor that is energised simultaneously, but independently from the encapsulated conductive material. The first and third conductive material 2 and 2' may also be energized separately.

Figure 2:
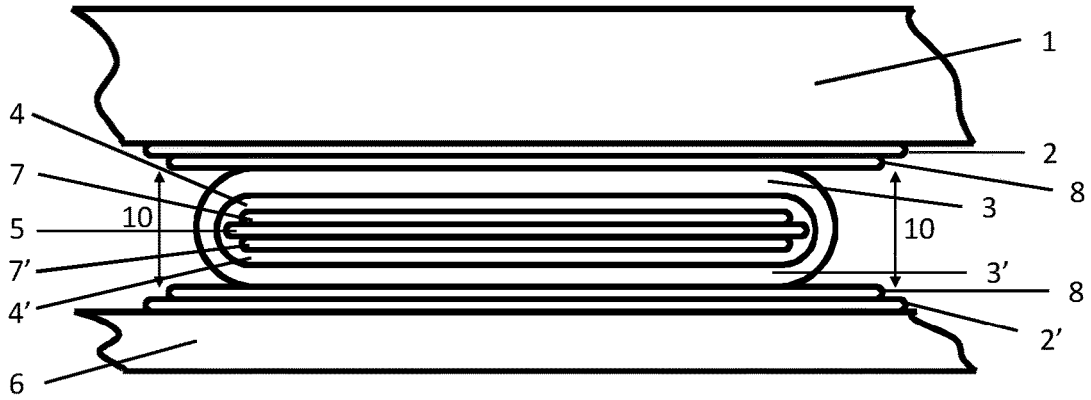
FIG. 2 is a schematic cross-sectional diagram of an electroluminescent element in another embodiment.

FIG. 2 is a cross sectional diagram illustrating the different layers of an electroluminescent element in another embodiment similar to that of FIG. 1, but including layers that promote both electron and hole transport, there being a hole transport substance 8 and an electron transport top and bottom substance 7 and 7' respectively. The hole transport substance 8 is a mixed P doped semiconductor material, that is combined in a mixture that enables the printing or coating of the substance on the substrate using methodologies known in the art. The hole transport substance 8 is printed or coated upon the first transparent or coloured conductive material 2. This substance is designed to provide a more even surface for printing or coating the next layer, which in turn will provide much better contact between the conductive material 2 and the transparent or coloured dielectric 3. The hole transport layer 8 promotes and improves the transport efficiency of positive charge in the construction.

The transparent or coloured dielectric 3 is then printed or coated over the top of the hole transport layer 8, forming a shape that will be larger than the next layer to be printed or coated, and larger than the top first transparent or coloured conductive material 2 and the hole transport layer 8. This larger dielectric shape will form part of the encapsulation for other conductive layers. A light emitting substance 4 is then printed or coated in a smaller shape than the former layer of dielectric 3 and will form part of the encapsulation for other conductive layers.

The electron transport substance 7 is a mixed N doped semiconductor material, that is combined in a mixture that enables the printing or coating of the substance on the substrate using methodologies known in the art. This electron transport layer 7 is printed or coated on the light emitting substance 4, in a size that is smaller than the light emitting substance 4, and smaller than the conductive transparent or coloured conductive material 5 to be printed or coated onto the structure next. The electron transport layer 7 substantially increases the flow of negatively charged particles and smooths the uneven surface between the light emitting substance 4, and the second conductive transparent or coloured conductive material 5, greatly improving electron flow.

The second conductive transparent or coloured conductive material 5 is then printed or coated on the surface of the electron transport layer 7. The second conductive transparent or coloured conductive material 5 must be larger than the electron transport layer 7 to enable the encapsulation of the conductor by the light emitting substance 4.

A second electron transport layer 7', is then printed or coated on the opposite side of the second conductive transparent or coloured conductive material 5, at a smaller size that the second conductive transparent or coloured conductive material 5, and performs the same or similar function as the former electron transport layer 7. A light emitting substance 4 is then printed or coated, in a larger size, over the surface of the second conductive transparent or coloured conductive material 5, and the electron transport layers 7 and 7', encapsulating it in the light emitting substance 4. A portion of the second conductive transparent or coloured conductive material 5 will be connected to an electronic circuit, meaning that a portion of the encapsulated second transparent or coloured conductive material 5 will be exposed to enable connection to other sections of an electronic circuit. In the event that the configuration is a passive or active matrix, the second transparent or coloured conductive material 5 will be arranged in a row/column configuration.

The light emitting substance 4 is then printed or coated with a transparent or coloured dielectric 3 encapsulating the light emitting substance 4, and the second transparent or coloured conductive material 5 that has already been encapsulated by the light emitting substance 4.

The transparent or coloured dielectric 3 is then printed or coated with a hole transport substance 8 that is designed to provide a more even surface for the printing or coating of the next layer, which in turn will provide a much better contact between the conductive material 2, and the transparent or coloured dielectric 3. The hole transport layer 8 promotes and improves the transport efficiency of positive charge in the construction.

The conductive material 2 may be formed into a pattern that conforms to a circuit design, depending on the configuration of the electroluminescent device. Both conductive materials 2 and 2' can be connected together to form a conductor that is energised simultaneously, but independently from the encapsulated conductive material 5. The first and third conductive material 2 and 2' may also be energised separately.

The cavities 10 that are left by the encapsulation process may be filled by an insulator that provides additional isolation between light emitting elements and smooths out the surface for further printing or coating of material. The assembly process as described in FIGS. 1 and 2 can also be done in reverse order.

The light emitting system is then printed or coated with a second substrate 6, which can be glass, paper, wood, plastic, fabric, metal or any composite material. It is possible that the process order maybe reversed and that transparent substrate 1, and/or a second substrate 6, could be printed or coated onto pre-assembled encapsulated elements, as described in FIGS. 1 and 2.

Figure 3:
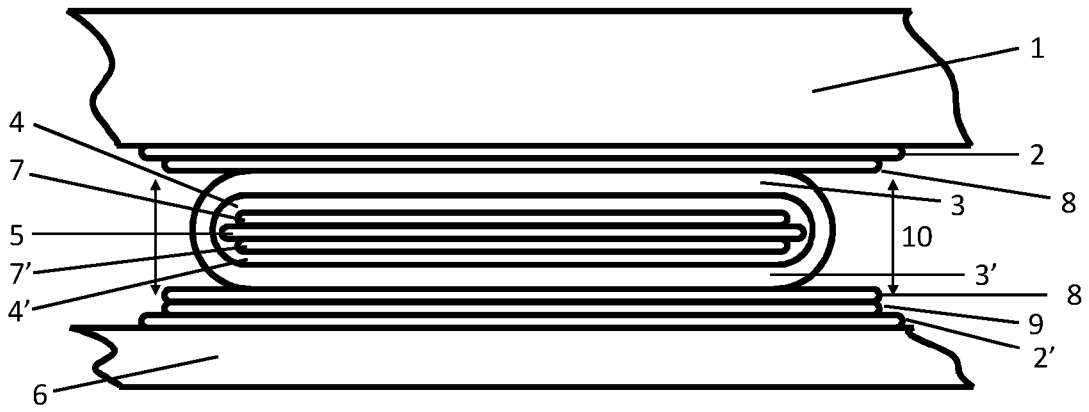
FIG. 3 is a schematic cross-sectional diagram of an electroluminescent element in another embodiment.

FIG. 3 is another cross sectional diagram illustrating the layers within an EL element in an embodiment similar to that of FIG. 2, but including a semiconductor layer 9. In this embodiment a semiconductor layer 9 is printed or coated slightly smaller than the third conductive material 2', this provides a switch threshold control to the conducting layer, providing better control over the light emitting elements associated to light production.

Vertical Alignment

Figure 4:
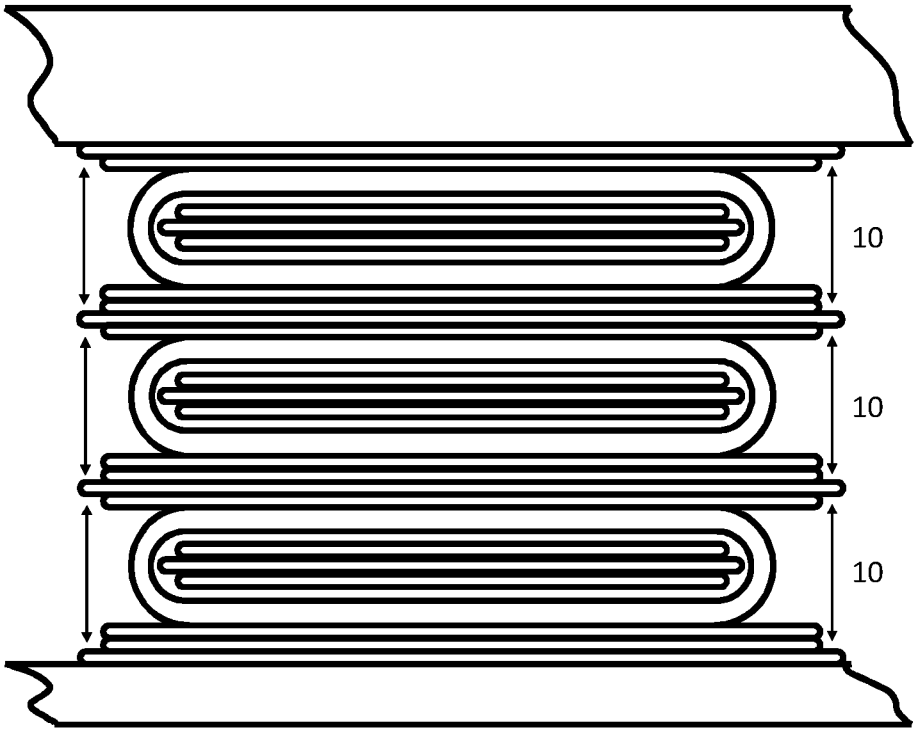
FIG. 4 is a schematic cross-sectional diagram of a plurality of electroluminescent elements of any of the embodiments of FIGS. 1 to 3, arranged in a vertical stack configuration.

In an alternative embodiment, and as shown in FIG. 4, a plurality of EL elements, constructed for example by methods described in the previous embodiments, are stacked one on top of the other. The construction of the EL elements enables each electrode in the stack to be energised individually and/or in groups depending on their configuration. The construction of the EL elements prevents or reduces crosstalk between the layers enabling the stack construction to work effectively. The transparent/translucent properties of the construction enable light transmission through the layers with minimum obstruction. Where the layers of different ones of the stacked elements are of different colours, such as red, green and blue, selective colour mixing can be achieved. Multiple layers of EL elements can be stacked using this method of construction, so that light output can be increased in a small area, crosstalk between EL elements can be dramatically reduced and many colours can be used per stack.

Horizontal Alignment

Figure 5:
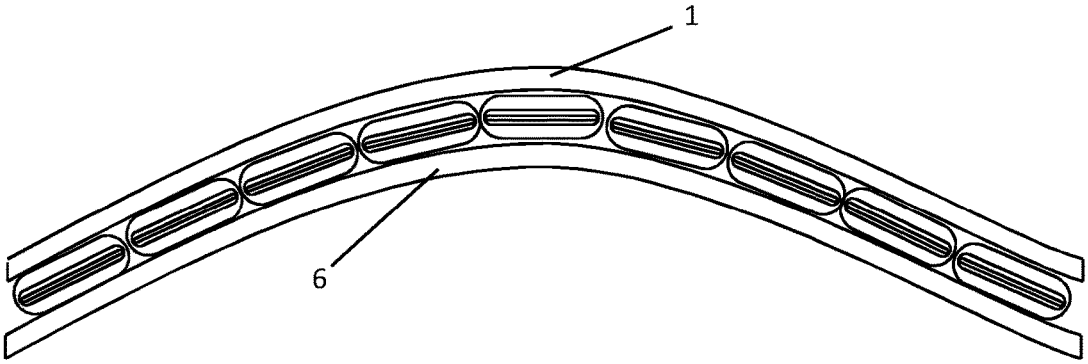
FIG. 5 is a schematic cross-sectional diagram of a plurality of electroluminescent elements of any of the embodiments of FIGS. 1 to 3, arranged in a horizontal array such that the system can be flexed.

In a further embodiment, FIG. 5 illustrates a plurality of EL elements constructed by any of the methods prescribed in FIGS. 1-3, wherein the EL elements are configured in an array aligned along their respective horizontal axes. The shape and construction of such an array of EL elements allows for the array to flex when placed under strain, such that there is minimal impact on the EL element structures and their related contacts. Such a property is beneficial when creating flexible lighting or displays.

ALTERNATIVE EMBODIMENTS

The substrates 1, 6 are described as both being transparent in the above embodiments, in order to allow light to be emitted in both directions parallel to the layers. Alternatively, light may be reflected from or before one of the substrates 1, 6 and emitted through the other substrate, so that only one of the substrates needs to be transparent.

Although the layers are described as being transparent, the layers may alternatively be translucent.

Although the layers are described as being coloured, this is only necessary when a coloured light output is required. Even in that case, not all of the layers need to be coloured, or none at all if a separate colour filter layer is provided.

Printing or coating are identified as possible methods of depositing layers or substrates, but other methods known per se to the skilled person may be used.

The invention claimed is:

1. An electroluminescent element, comprising at least the following layers, in sequence:

i. a first substrate,
ii. a first conductive layer,
iii. a first dielectric layer,
iv. a first light emitting layer,
v. a second conductive layer,
vi. a second light emitting layer,
vii. a second dielectric layer,
viii. a third conductive layer, and
ix. a second substrate;

wherein at least one of the first and second substrates is transparent or translucent, at least one of the first and third conductive layers is transparent or translucent, and at least one of the first and second dielectric layers is transparent or translucent, so as to allow light from the first and/or second light emitting layers to be emitted through the transparent substrate or substrates; and the second conductive layer is completely encapsulated between the first and second light emitting layers.

2. The electroluminescent element of claim 1, wherein the first and third conductive layers are connected together.

3. The electroluminescent element of claim 1, wherein the second conductive layer is electrically separated from the first and third conductive layers.

4. The electroluminescent element of claim 1, including a hole transport layer between the first conductive layer and the first dielectric layer, and/or between the second conductive layer and the second dielectric layer.

5. The electroluminescent element of claim 1, including an electron transport layer between the second conductive layer and the first and/or second light emitting layer.

6. A method of construction of an electroluminescent element, comprising:

i. providing a first substrate,
ii. providing a first conductive layer on or over the first substrate,
iii. providing a first dielectric layer on or over the first conductive layer,
iv. providing a first light emitting layer on or over the dielectric layer,
v. providing a second conductive layer on or over the light emitting layer,
vi. providing a second light emitting layer on or over the second conductive layer,
vii. providing a second dielectric layer on or over the second light emitting layer, and
viii. providing a second substrate on or over the second dielectric layer, including a third conductive layer disposed between the second dielectric layer and the second substrate;

wherein at least one of the first and second substrates is transparent or translucent, at least one of the first and third conductive layers is transparent or translucent, and at least one of the first and second dielectric layers is transparent or translucent, so as to allow light from the first and/or second light emitting layers to be emitted through the transparent substrate or substrates; and the second conductive layer is completely encapsulated between the first and second light emitting layers.

7. The method of claim 6, wherein the third conductive layer is provided on the second substrate prior to providing the transparent substrate on or over the second dielectric layer.

8. The electroluminescent element of claim 1, wherein the first and second light emitting layers are encapsulated between the first and second dielectric layers.

9. The method of claim 6, wherein the step of providing one or more of the layers comprises a printing or coating process.

10. The electroluminescent element of claim 1, wherein one or more cavities between the first and second substrates are filled by an insulator.

11. The method of claim 6, wherein an electron transport layer is provided on one or both sides of the second conductive layer.

12. The method of claim 11, wherein the second conductive layer and the electron transport layer are encapsulated by the light emitting layers.

13. The electroluminescent element of claim 1, wherein a semiconductor layer is provided on or over the first conductive layer.

14. The electroluminescent element of claim 1, wherein a semiconductor layer is provided on or over the third conductive layer.

15. The electroluminescent element of claim 1, wherein at least one of the layers and/or substrates is coloured so that the light emitted through the first and/or second substrates is coloured.

16. The method of claim 6, wherein the first and second light emitting layers are encapsulated between the first and second dielectric layers.

17. The method of claim 6, wherein one or more cavities between the first and second substrates are filled by an insulator.

18. The method of claim 6, wherein a semiconductor layer is provided on or over the first conductive layer.

19. The method of claim 6, wherein at least one of the layers and/or substrates is coloured so that the light emitted through the first and/or second substrates is coloured.

* * * * *